US009938750B2

(12) United States Patent
Moore et al.

(10) Patent No.: US 9,938,750 B2
(45) Date of Patent: Apr. 10, 2018

(54) LABELING SYSTEM

(71) Applicant: Write-On-It! LLC, Shoreline, WA (US)

(72) Inventors: Brian A. Moore, Lynnwood, WA (US); Bruce B. Bailey, Seattle, WA (US); Matthew B. McCutchen, Shoreline, WA (US)

(73) Assignee: Write-On-It! LLC, Seattle, WA (US)

( * ) Notice: Subject to any disclaimer, the term of this patent is extended or adjusted under 35 U.S.C. 154(b) by 401 days.

(21) Appl. No.: 14/031,029

(22) Filed: Sep. 18, 2013

(65) Prior Publication Data

US 2014/0116101 A1 May 1, 2014

Related U.S. Application Data

(63) Continuation of application No. 12/595,492, filed as application No. PCT/US2008/060108 on Apr. 11, 2008, now abandoned.

(Continued)

(51) Int. Cl.
*B05D 3/02* (2006.01)
*E05B 19/00* (2006.01)

(Continued)

(52) U.S. Cl.
CPC ..... *E05B 19/0088* (2013.01); *E05B 19/24* (2013.01); *G09F 23/00* (2013.01); *Y10T 70/7441* (2015.04); *Y10T 70/7881* (2015.04)

(58) Field of Classification Search
CPC ..... E05B 19/0088; E05B 19/24; B05D 7/14; Y10T 70/7441; Y10T 70/7881; G09F 23/00

(Continued)

(56) References Cited

U.S. PATENT DOCUMENTS 1,816,642 A 7/1931 Fetter
2,759,279 A 8/1956 Schlage (Continued)

FOREIGN PATENT DOCUMENTS

GB 2045852 11/1980
JP 7243276 9/1995

(Continued)

OTHER PUBLICATIONS

Ecology Coatings Granted Quadruple Patent Approval for Low-Energy, Low-Emission Industrial Coatings—Four Key Clean Technology Patents Enable Market Expansion and Strategic Alliances, URL=http://www.prweb.com/ releases/2006/12/prweb492945.htm, download date May 20, 2010, 2 pages.

(Continued)

*Primary Examiner* — Robert S Walters, Jr.
(74) *Attorney, Agent, or Firm* — Perkins Coie LLP

(57) ABSTRACT

Embodiments disclosed herein can include one or more labels, each label having an indicia receiving surface adapted to receive indicium or indicia. The indicia receiving surface can provide a permanent, durable writing surface. A key for operating a mechanical lock can include one or more labels. The key can include a key main body and at least one label coupled to the key main body. The key main body comprises a head and an elongate body coupled to the head. The elongate body is configured to physically engage and operate a lock, such as a mechanical lock. The label can define an indicia receiving surface adapted to receive indicium or indicia.

14 Claims, 9 Drawing Sheets

Related U.S. Application Data

(60) Provisional application No. 60/923,271, filed on Apr. 12, 2007.

(51) Int. Cl.
*E05B 19/24* (2006.01)
*G09F 23/00* (2006.01)

(58) Field of Classification Search
USPC ..... 427/388.1
See application file for complete search history.

(56) References Cited

U.S. PATENT DOCUMENTS

| | | | | |
|---|---|---|---|---|
| 2,759,280 | A | 8/1956 | Schlage | |
| 3,093,920 | A | 6/1963 | Epstein et al. | |
| 3,209,479 | A | 10/1965 | Manzardo | |
| 3,324,586 | A | 6/1967 | Mitchell | |
| 3,729,965 | A | 5/1973 | Gartner | |
| 3,782,017 | A | 1/1974 | Graham | |
| 4,025,578 | A | 5/1977 | Siebert | |
| 4,188,741 | A | 2/1980 | Levy | |
| 4,417,410 | A | 11/1983 | Freedom | |
| 5,181,605 | A | 1/1993 | Bishop et al. | |
| 5,726,221 | A | 3/1998 | Alexiou | |
| 5,870,917 | A | 2/1999 | Mahot et al. | |
| 5,908,273 | A * | 6/1999 | Titus et al. | 409/81 |
| 6,094,954 | A | 8/2000 | Carmen | |
| 6,604,308 | B1 | 8/2003 | Robles | |
| 7,151,123 | B2 | 12/2006 | Ramsey | |
| 7,153,892 | B2 | 12/2006 | Ramsey | |
| 7,192,992 | B2 | 3/2007 | Ramsey | |
| 2004/0028825 | A1 | 2/2004 | Manes | |
| 2005/0129883 | A1 * | 6/2005 | Snow | 428/32.31 |
| 2005/0170100 | A1 | 8/2005 | Weine Ramsey | |
| 2005/0170101 | A1 | 8/2005 | Ramsey | |
| 2005/0170280 | A1 | 8/2005 | Ramsey | |
| 2005/0171227 | A1 | 8/2005 | Weine Ramsey | |
| 2005/0196605 | A1 | 9/2005 | Ramsey | |
| 2005/0203202 | A1 | 9/2005 | Weine Ramsey | |
| 2005/0203205 | A1 | 9/2005 | Weine Ramsey | |
| 2005/0234152 | A1 | 10/2005 | Ramsey | |
| 2006/0026878 | A1 | 2/2006 | Slater | |
| 2006/0041047 | A1 | 2/2006 | Ramsey | |
| 2006/0258765 | A1 | 11/2006 | Ramsey | |
| 2006/0265917 | A1 | 11/2006 | Wilson | |
| 2007/0071965 | A1 | 3/2007 | Ramsey | |
| 2010/0269382 | A1 | 10/2010 | Moore et al. | |

FOREIGN PATENT DOCUMENTS

| | | |
|---|---|---|
| JP | 10317745 | 12/1998 |
| JP | 2007-011441 | 1/2007 |
| JP | 2007-062129 | 3/2007 |
| WO | WO-9524709 | 9/1995 |

OTHER PUBLICATIONS

Ecology Coatings Launches Licensing Program for Liquid Nanotechnology, URL=http://www.nanotechwire.com/news.asp?nid=1813, download date May 20, 2010, 2 pages.

Outdoor Gear—Buy Outdoor Gear, Backpacks, Columbia Online, URL=http://www.moleculartorch.com/2006/03/ecology-coatings.html, download date May 20, 2010, 2 pages.

Initial Publication of WO2008/128101 with PCT International Search Report, PCT Application US2008/060108, dated Oct. 23, 2008, 30 pages.

International Search Report and Written Opinion, PCT Application US2008/060108, dated Aug. 19, 2008, 5 pages.

European Patent Office, European Search Report, EP Application 08780521.4, dated Apr. 21, 2010, 9 pages.

Japan Patent Office, Official Office Action, counterpart JP Patent Application 2010-503250, dated Dec. 4, 2012, 5 pages.

Japan Patent Office, Official Office Action, counterpart JP Patent Application 2010-503250, dated Jul. 2, 2013, 2 pages (English translation).

State Intellectual Property Office of China, First Office Action, counterpart CN Patent Application 200880020142.7, dated Feb. 1, 2012, 6 pages.

State Intellectual Property Office of China, Second Office Action, counterpart CN Patent Application 200880020142.7, dated Jan. 25, 2013, 6 pages.

Canadian Intellectual Property Office, Examiner's Report, counterpart CA Patent Application 2,720,653, dated May 21, 2015, 2 pages.

* cited by examiner

LABELING SYSTEM

CROSS-REFERENCE TO RELATED APPLICATIONS

This application is a continuation of U.S. application Ser. No. 12/595,492 filed on Jun. 14, 2010 which is national stage entry of International Application No. PCT/US08/60108 filed on Apr. 11, 2008 and which claims the benefit under 35 U.S.C. § 119(e) of U.S. Provisional Patent Application No. 60/923,271, filed on Apr. 12, 2007. Each of these applications is incorporated herein by reference in their entireties.

BACKGROUND

1. Technical Field

The present disclosure and some embodiments generally relate to a label system, and more specifically, to a label system with at least one writable surface.

2. Description of the Related Art

Various types of objects do not have a suitable writing surface. For example, metal keys for unlocking locks (e.g., car door locks, house locks, padlocks, etc.) do not have a suitable writing surface. These keys are often made from a flat piece of metal configured to engage movable pins in the lock. To unlock a lock, a key can be inserted into the lock and then turned to align the lock's internal pins. Once the internal pins are properly aligned, the lock can be opened. Unfortunately, the outer metal surface of the key does not provide a suitable writing surface for receiving ink or graphite from a writing instrument. An individual often memorizes the size or shape of certain keys and corresponding locks in order to select the proper key for opening the lock. It is often difficult to remember which key corresponds to a particular lock, especially if a large number of keys are kept together, for example, on a key chain or key ring.

SUMMARY

Some embodiments disclosed herein include the realization that a label system can be applied to various types of objects. The label system can include one or more labels, each label having a receiving surface adapted to receive indicium or indicia. As used herein, the term "indicia" is broadly construed to include, without limitation, one or more symbols, text, characters, numerals, graphics, artwork, logos, trademarks, decorative elements, handwriting, printing, combinations thereof, and other markings that can be used to convey information.

The receiving surface can be a writable surface for permanently retaining an applied substance, such as ink, graphite, and the like. The writable surface can protect the substance that has been written onto it from smudging or smearing after the substance has dried, set, or the like. Smudging or smearing can cause significant visual alterations of the applied substance. For example, if text is written on the writable surface using the applied substance, smudging or smearing may render the text unrecognizable. Non-permanent ink is one type of substance that is prone to smudging and/or smearing if applied directly to a metal surface. Advantageously, writing (e.g., writing in ink and/or graphite) on the writable surface can retain its shape even when a person slides, for example, their fingers across the writing.

In some ink writable embodiments, the writable surface is more ink penetrable than a surface to which the label system is applied. The amount of ink that permanently penetrates into and through the writable surface is greater than the amount of ink that penetrates the surface to which the label system is applied.

The label system in some embodiments may include at least one label that is temporarily or permanently coupled to a non-writable surface of an object, such as a metal surface. The label can be a monolayer (e.g., a single substrate) or multilayer label. In multilayer embodiments, the label can include one or more layers of paint, polymers, coating materials, combinations thereof, and other materials suitable for forming a writing label.

The label can be coupled to various types of objects (e.g., keys, tools, and other known objects) having at least one surface (e.g., a surface that is suitable or unsuitable for receiving indicia). Many types of surfaces can be somewhat unsuitable for writing upon, such as bare metal surfaces. The label can improve writability, legibility of writing, and the like. The label can be applied to metal, ceramic, composites, or plastic, as well as other materials suitable for receiving the label.

In some embodiments, a key for operating a mechanical lock comprises a key main body and a label system coupled to the key main body. The key main body comprises a head and an elongate body connected to the head. The elongate body is configured to physically engage and operate the mechanical lock. The label system defines a writable surface. The head, in some embodiments, can be conveniently gripped by a user to insert the key into the lock.

The label system in some embodiments includes a writable surface made by a process comprising applying a liquid composition to the key main body and allowing the liquid composition to form a solid layer defining the writable surface. In some embodiments, the writable surface is adapted to protect a substance (e.g., ink or solid pigment, or both) that is applied to the writable surface via a writing implement from at least one of smudging and smearing.

In some embodiments, a key comprises a key body and means for receiving and permanently retaining indicia written by a writing instrument. The means for receiving and permanently retaining indicia is coupled to the key body. The key body comprises a head and an elongate body coupled to the head. The elongate body is configured to physically engage and operate a lock. The means for receiving indicia can protect a substance applied thereto using a writing implement.

In some embodiments, a key comprises a label system coupled to a key main body. The label system can comprise mostly a first material, and the key main body can comprise mostly a second material that is different from the first material. For example, the label system can comprise at least 90% by weight of a polymer, and the key main body can comprise at least 90% by weight of a metal. If needed or desired, an adhesive or bonding agent can be used to couple the label system to the key main body.

In some embodiments, a method of manufacturing a key is provided. The method can include coupling a label system to a key blank. The label system can have a first surface and a second surface opposing the first surface. In some embodiments, the first surface includes a writable surface, and the second surface can be physically coupled to the key blank.

In some embodiments, a method of manufacturing a key comprises applying a liquid to a key blank and allowing the applied liquid to become solid so as to form a label system. The liquid can become a solid via drying, cross-linking, cooling, setting, and the like. The label system has a first surface and a second surface opposing the first surface. The first surface, in some embodiments, includes an anti-smudge, anti-smear writable surface adapted to receive a substance from a writing implement. The second surface is physically coupled to the key blank. In some embodiments, the anti-smudge, anti-smear properties are somewhat similar or equal to the anti-smudge, anti-smear properties of conventional writing paper or notebook paper.

In some embodiments, the writable surface of the label system disclosed herein includes an anti-smudge and/or anti-smear finish. The finish can reduce, inhibit, or substantially prevent marring of a substance applied to the writable surface. The properties of the writable surface can allow, for example, a ballpoint pen to convenient apply ink onto the writable surface or a pencil to apply a solid pigment (e.g., graphite, charcoal, etc.) onto the writable surface. The coefficient of friction of the writable surface can be sufficiently high to permit the writing instrument to consistently apply a substance. In some embodiments, the coefficient of friction is similar or equal to the coefficient of friction of conventional writing paper or notebook paper. The frictional interaction between the writing instrument and the writable surface can be increased or decreased, as desired. Thus, a user can conveniently apply permanent writing to the writable surface using a wide range of writing instruments.

A label of the label system can be physically coupled to a key blank via one or more adhesives. Additionally or alternatively, the label can be directly coupled to the key blank. For example, a substance, such as paint, can be applied to the key blank to form the discrete label. The paint contacting the key blank can dry to physically couple the label to the key blank.

In some embodiments, one or more bittings can be formed in an elongate main body of a key blank after coupling a label system to the key blank. Advantageously, different key blanks and label systems can be selected for a desired machining process. Bittings can be formed in the elongate main body without damaging or altering the label system. For example, the label system can be applied to a flat head of the key blank from which the elongate main body extends.

After forming the bittings, a user can write one or more indicium on the writable surface of the label system. Alternatively, one or more indicium can be applied to the writable surface before forming the one or more bittings. Thus, the key blank with a writing or label system provides flexibility when applying indicium.

In some embodiments, a key comprises a label system and a key main body that is relatively thick as compared to the label system. The label system can include a first surface and a second surface opposing the first surface. A thickness can be defined by the first and second surfaces. This thickness can be less than a thickness of a flat head of the key main body.

A label can comprise one or more compositions. A composition can be made, in whole or in part, of paper, fibers, plastics, resins, polymers, rubber, additives (e.g., nanoparticles, light activated additives, and other additives to alter the properties of the label), paint, adhesives, binders, fillers, or combinations thereof. The monolayer or multilayer label can be made of one or more materials that can provide a suitable writing surface. For example, the label can be made of fibers (wood pulp) and one or more additives (e.g., nanoparticles) that improve properties of the label, such as water resistance, writability, and the like. The label can be made of natural materials or synthetic materials, or both.

DETAILED DESCRIPTION

The present detailed description is generally directed to a label system having at least one indicia receiving surface suitable for receiving various types of indicium or indicia. The label system can be applied to an outer surface of an object so as to improve the ability to label and identify the object. Many specific details and certain embodiments are set forth in the following description and in FIGS. 1-16 to provide a thorough understanding of such embodiments. One skilled in the art, however, will understand that the disclosed embodiments may be practiced without one or more of the details described in the following description. Additionally, label systems are discussed in the context of keys because they have particular utility in this context. For example, labels of label systems disclosed herein are particularly well suited for use with keys that open mechanical locks. However, the labels can be used in other contexts, such as, for example, on other types of metal objects, fasteners, tools, equipment, and other items that have exterior surfaces, such as non-writable, semi-writable, or writable surfaces.

It should be noted that, as used in this specification and the appended claims, the singular forms "a," "an," and "the" include plural referents unless the context clearly dictates otherwise. For example, the term "a label" includes a single label and/or a plurality of labels. It should also be noted that the term "or" is generally employed in its sense including "and/or" unless the content clearly dictates otherwise.

Figure 1:
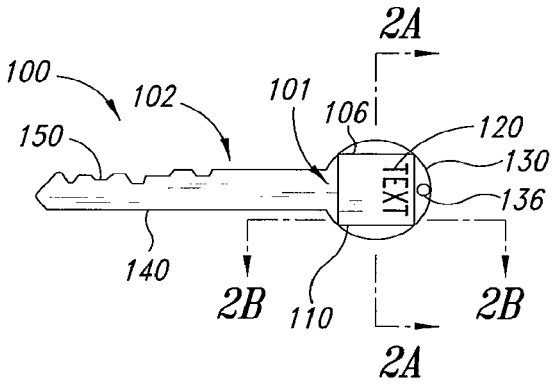
FIG. 1 is a plan view of a key with a label having an indicia receiving surface, in accordance with one illustrated embodiment.

FIG. 1 illustrates a key 100 having a label system 101 coupled to a key main body 102. The label system 101 includes a label 106 with an indicia writing surface 110. Indicia 120 (illustrated as readable text) for identifying the key 100 are on the indicia writing surface 110. The illustrated key main body 102 includes a head 130, an opening 136 in the head 130, and an elongate main body 140 extending from the head 130.

The key 100 can be used to unlock various types of locks (e.g., door locks such as car door locks, house door locks, padlocks, and the like), ignition system locks, and other types of locks known in the art. The indicia 120 can identify which lock can be unlocked with the key 100. For example, a user can write on the indicia writing surface 110 to identify the key 100 with a corresponding lock. If the key 100 is kept with other keys, the user can use the indicia 120 to distinguish the key 100 from the other keys.

To unlock a lock, a user can conveniently grasp the head 130 and insert the elongate main body 140 into an opening of the lock. Once the key 100 is properly inserted into the lock, the user can rotate the key 100 to move internal components of the lock until the lock is opened.

As used herein, the term "key" is a broad term that includes, but is not limited to, a mechanical structure or device which is used to operate and open a lock. A mechanical key, for example, can physically contact, move, and align pins of a mechanical lock. Exemplary keys can be in the form of a house key, automobile key, skeleton key, barrel key (e.g., a key used to open a bicycle lock), and the like. Sensors, chips (e.g., RFID chips), transponders, power supplies (e.g., batteries), combinations thereof, and other types of components or systems can be incorporated into the key. Thus, the label system 101 can be used with various types of keys.

The illustrated key 100 of FIG. 1 is in the form of a one-sided key suitable for unlocking a mechanical lock. The elongate body 140 includes a contoured section 150 configured to engage one or more internal movable components of the lock. For example, the contoured section 150 can contact, move, and align pins of the lock. The contoured section 150 can comprise one or more bittings, grooves, teeth, notches, indentations, protuberances, and other features suited for engaging lock pins. The illustrated contoured section 150 of FIG. 1 includes a series of bittings. In some embodiments, the key 100 can be a double-sided key wherein opposing longitudinal sides of the elongate body 140 each include contoured sections.

Figure 2A:
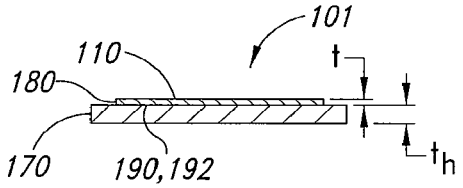
FIG. 2A is a cross-sectional view of the key of FIG. 1 taken along the line 2A-2A.

Referring to FIG. 2A, the head 130 includes a head main body 170 and the label system 101 coupled to the head main body 170. The illustrated label system 101 includes a single substrate 180 that defines the indicia receiving surface 110 (e.g., a writable surface) and a coupling surface 190 opposing the receiving surface 110. The coupling surface 190 is permanently bonded or coupled to a coupling surface 192 of the head main body 170 via paint, printing substances or other types of coatings, or via a bonding agent, adhesive (e.g., a pressure sensitive adhesive), or other types of coupling substances suitable for coupling substrates to non-writable surfaces. In some embodiments, material of the label system 101 may bond (e.g., physically bond, fuse, and the like) to the surface 192. For example, the label system 101 may bond to the surface 192 without any additional adhesive or bonding agent, even if the surface 192 is a non-writable surface. Non-writable surfaces can be bare metal surfaces, ceramic surfaces, and the like. Advantageously, the substrate 180 can provide an excellent writable surface as compared to non-writable or semi-writable surfaces. The substrate 180 can be applied to a writable surface to improve the visibility of indicia applied to the substrate 180, as compared to the same indicia applied directly to the writable surface.

The receiving substrate 180 can be a layer, film, coating, sheet, or the like. The thickness t of the substrate 180 can be less than the thickness $t_h$ of the head 130. Thus, the substrate 180 may not noticeably alter the feel of gripping the head 130. In other embodiments, the thickness t of the substrate 180 can be equal to or greater than the thickness $t_h$ of the head 130.

The receiving substrate 180 can be coupled to the key main body 102 before, during, or after the formation of the contoured section 150 of FIG. 1. For example, the receiving substrate 180 can be applied to a key blank, which is subsequently machined to form the contoured section 150, as discussed in connection with FIGS. 14A-14D. Alternatively, the substrate 180 can be formed or applied while the contoured section 150 is formed, thus providing a one-step fabrication process for rapidly producing the key 100.

Various types of manufacturing processes can be used to form the receiving substrate 180. Painting (e.g., brush painting, drip on painting, and the like), deposition processes (e.g., chemical vapor deposition, physical vapor deposition, and the like), spraying, dipping, printing (e.g., pad printing), and other types of coating processes can be used to form the receiving substrate 180. For example, the receiving substrate 180 can be formed by applying a liquid onto the head main body 170. In some embodiments, the liquid (e.g., a flowable substance such as paint, a uncured polymer, a thermoplastic at or above its melt temperature, and the like) is painted onto the head main body 170. The liquid can set, cure, or dry to form the solid substrate 180. In some embodiments, a preformed receiving substrate 180 (e.g., a precut adhesive film) is applied to the head main body 170. The substrate 180 can comprise paint, polymers, adhesives, binders, fillers, fibers (e.g., plant fibers, wood fibers, and the like), dyes, colorants, additives, combinations thereof, and other substances suitable for forming a writing surface. Additionally, the receiving substrate 180 can comprise a first material and the key body 102 can comprise a second material that is different than the first material. The first material can have better writing characteristics, e.g., the ability to receive ink.

The surface 110 of FIG. 2A can be configured to temporarily or permanently receive ink, graphite, or other marking substances. The substrate 180, for example, can be porous in order to retain ink. Texturing (e.g., a matte finish texturing process), surface treatments, and other surface preparation procedures can form a desired surface 110. In some embodiments, the surface 110 can receive ink from ballpoint pens, gel rollers, markers (e.g., permanent markers such as SHARPIE® permanent markers), and/or other types of writing instruments. In some embodiments, pencils can be used to write on the surface 110. Other types of writing instruments can also be used to mark the surface 110.

The color of the surface 110 can serve as an identifier or provide contrast with the indicia 120. For example, a white surface 110 is especially well suited to receive colored identifiers (i.e., non-white identifiers) or indicia. A colored surface 110 is especially well suited to receive identifiers or indicia of a different color. In some embodiments, different sections of the surface 110 can have different colors.

Figure 2B:
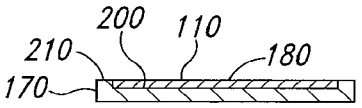
FIG. 2B is a cross-sectional view of the key of FIG. 1 taken along the line 2B-2B.

Referring to FIG. 2B, the head main body 170 includes a receiving section 200 for receiving at least a portion of the receiving substrate 180. The illustrated receiving section 200 is a recessed region configured to receive the receiving substrate 180. The head main body 170 can protect the substrate 180, thereby prolonging the life of the substrate 180. Additionally, the receiving section 200 can limit, inhibit, or substantially prevent movement of the substrate 180 relative to the head main body 170.

The receiving section 200 can be formed by a machining process, grinding process, molding process (e.g., injection molding, compression molding, and the like), cutting process, stamping process, combinations thereof, and the like. The receiving section 200 can be formed before, during, or after the formation of the elongate body 140, head main body 170, or both.

In some embodiments, the indicia receiving surface 110 can be positioned below the outer periphery 210 of the head main body 170. In other embodiments, the receiving substrate 180 can protrude outwardly from the outer periphery 210. In such embodiments, the receiving substrate 180 can provide a convenient gripping surface.

FIGS. 3-7 illustrate keys that may be generally similar to the key 100 of FIGS. 1 to 2B, except as detailed below. Like reference numerals refer to like parts or features throughout FIGS. 3 to 7, unless specified otherwise.

Figure 3:
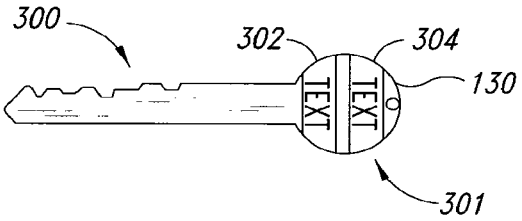
FIG. 3 is a plan view of a key with a label system, in accordance with one illustrated embodiment.

FIG. 3 shows a key 300 having a label system 301 with a plurality of receiving labels 302, 304. The illustrated spaced apart labels 302, 304 are coupled to the head 130. In other embodiments, the labels 302, 304 can be at other locations. Advantageously, different types of indicia can be placed on the labels 302, 304, and any number of labels can be applied to the key 300.

Figure 4:
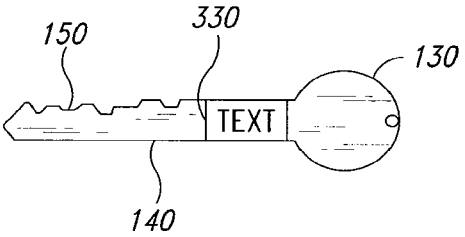
FIG. 4 is a plan view of a key having a label system positioned along an elongate main body of the key, in accordance with one illustrated embodiment.

FIG. 4 shows a label system 330 attached to the elongate body 140 at a location between the contoured section 150 and the head 130. When the elongate body 140 is inserted into a lock, at least a portion of the receiving substrate 330 is disposed in the lock. Alternatively, the elongate body 140 can have a longitudinal length sufficient such that, when the elongate body 140 operates the lock, a substantial portion or the entire receiving substrate 330 is positioned outside of the lock.

Figure 5:
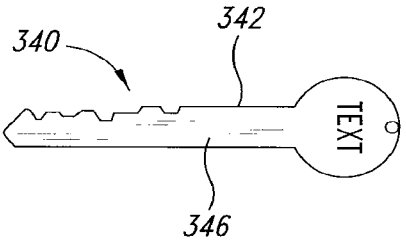
FIG. 5 is a plan view of a key having an outer indicia receiving surface, in accordance with one illustrated embodiment.

FIG. 5 shows a key 340 with a label system 342 forming the exterior surface 346 of the key 240. Both the elongate body 140 and head 130 can be dipped into coating material (e.g., a liquid coating material) that forms the label system 342. Advantageously, indicia can be placed at any location along the key 340.

Figure 6:
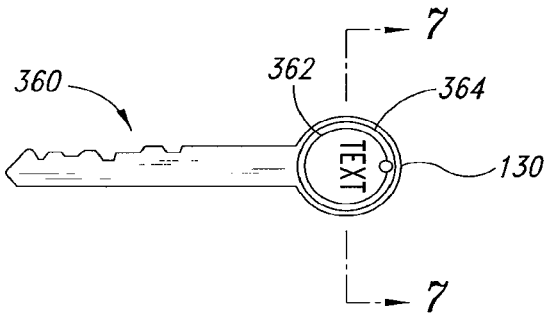
FIG. 6 is a plan view of a key having a label system on a head of the key, in accordance with one illustrated embodiment.
Figure 7:
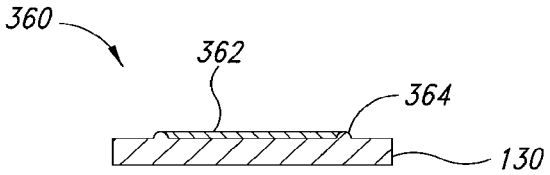
FIG. 7 is a cross-sectional view of the key of FIG. 6 taken along the line 7-7.

With respect to FIGS. 6 and 7, the illustrated key 360 includes a label system 362 in a receiving section 364. The receiving section 364 surrounds the label system 362 to protect and to limit, inhibit, or substantially prevent movement of the label system 362 relative to the head 130. The illustrated receiving section 364 is an annular protuberance that closely surrounds the label system 362. Other types of receiving sections can be formed by one or more lips, protrusions, protuberances (FIG. 7), recesses (FIG. 2B), and the like.

The label systems and their components described herein can have a shape that is generally polygonal (e.g., rectangular, square, trapezoidal, etc.), circular (see FIG. 7), elliptical, free form, combinations thereof, and the like. The number, size, and shape of the labels can be selected based on the configuration of the underlying supporting structure and/or receiving section, if any. In some embodiments, the labels are applied to a generally flat surface. The label systems can be positioned on one side or two sides of a key. For example, a first label can be positioned on a first face of the key, and a second label can be positioned on a second face of the key opposing the first face.

Figure 8:
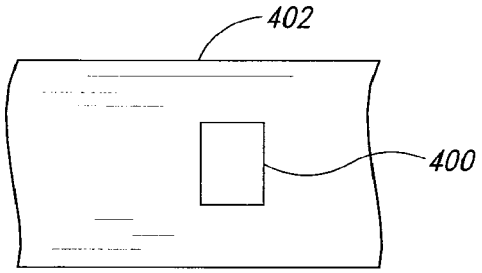
FIG. 8 is a plan view of a device with a label system, in accordance with one illustrated embodiment.
Figure 9:
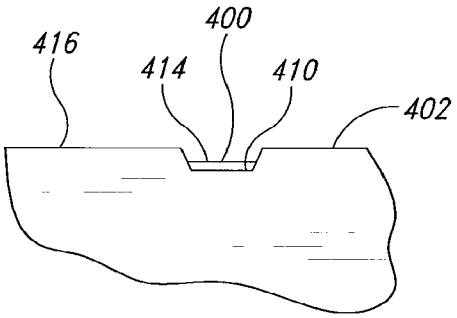
FIG. 9 is a side elevational view of the device of FIG. 8.

FIGS. 8 and 9 show a label system 400 of a device 402. The device 402 can be a tool (e.g., hammer, wrench, screwdriver, hand tool, and the like), mechanical device (e.g., a socket wrench, hand drill, hand sander, and the like), electronic equipment (e.g., oscilloscopic), medical equipment, and the like. The illustrated device 402 has a depressed section or panel 410 that receives the label system 400. An upper surface 414 of the label system 400 can be recessed from the surrounding outer surface 416 of the device 402, thereby protecting the label system 400 from unwanted contact with other objects.

Figure 10:
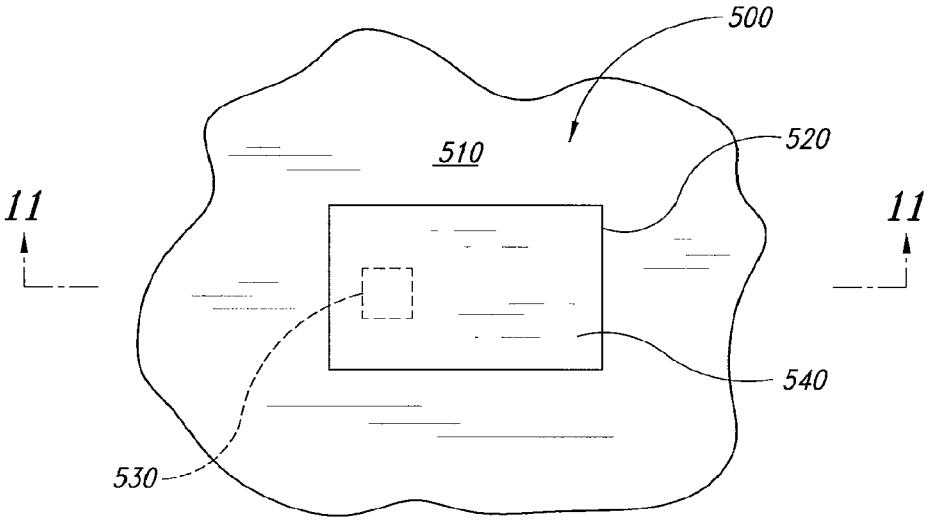
FIG. 10 is a plan view of a label system applied to a substrate.
Figure 11:
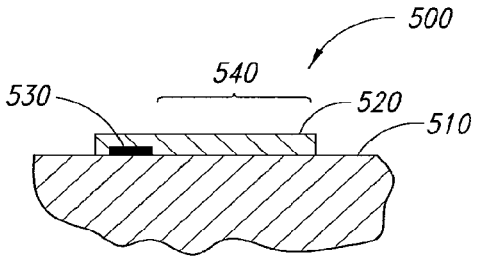
FIG. 11 is a cross-sectional view of the label system and substrate of FIG. 10 taken along the line 11-11.

FIGS. 10 and 11 show a label system 500 applied to a surface 510. The label system 500 includes a protective layer 520 that overlays a visual marker 530 (e.g., a logo or other type of indicia). A portion 540 of the protective layer 520 adjacent the visual marker 530 can be written upon without obscuring the visual marker 530. In some embodiments, the protective layer 520 can be optically transparent or semi-transparent to ensure easy viewing of the visual marker 530.

Figure 12:
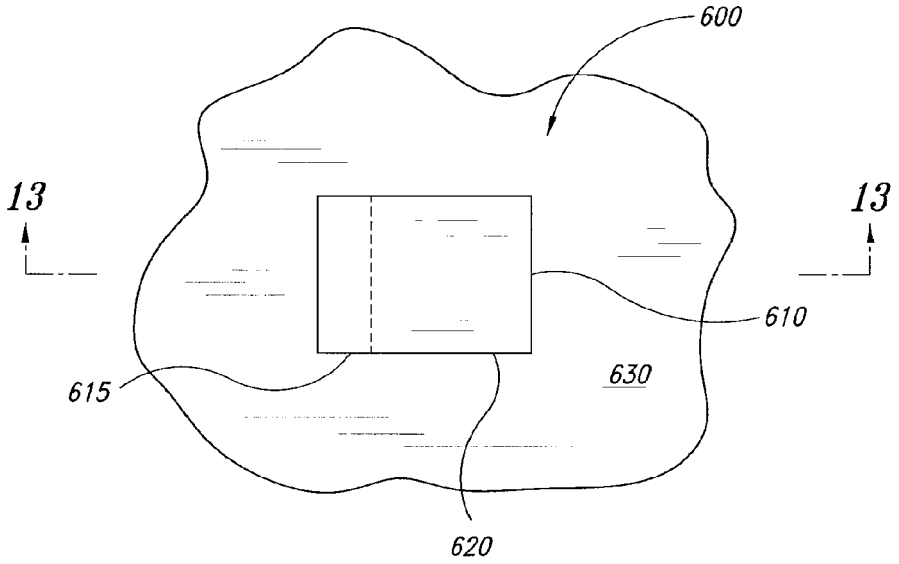
FIG. 12 is a plan view of a label system applied to a substrate.
Figure 13:
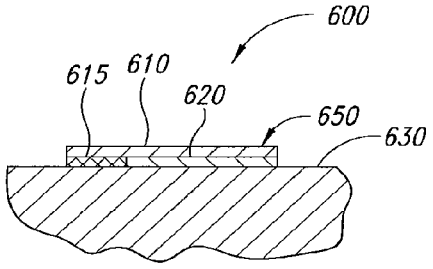
FIG. 13 is a cross-sectional view of the label system and substrate of FIG. 12 taken along the line 13-13.

FIGS. 12 and 13 show a label system 600 that includes a protective layer 610, visual marker 615, and a viewing enhancer 620 positioned between the surface 630 and the layer 610. The viewing enhancer 620 can be a colored surface or layer designed to improve visibility of indicia applied to the protective layer 610. For example, the viewing enhancer 620 can be a layer of white ink or paint applied to the surface 630. Non-white indicia (e.g., black text deposited via a permanent marker) applied to the upper writable surface 650 of the layer 610 can be easily viewed.

Figure 14A:
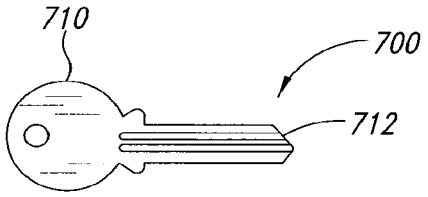
FIG. 14A is a plan view of a key blank, in accordance with some embodiments.

FIG. 14A shows a key blank 700 that can be made of a material that does not provide a suitable writing surface. The illustrated key blank 700 includes a head 710 and an elongate main body 712. The elongate main body 712 can be processed to form a desired contoured section for engaging and operating tumblers of a lock.

Figure 14B:
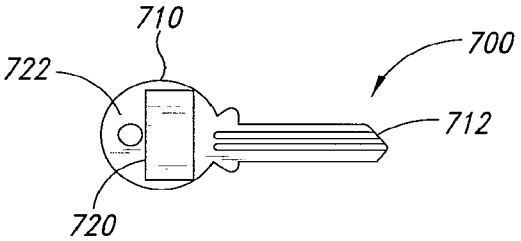
FIG. 14B is a plan view of the key blank of FIG. 14A and a label system applied to the key blank.

Referring to FIG. 14B, a label system 720 is applied to the head 710. The label system 720 can overlay at least 30%, 50%, 70%, or 90% of a surface 722 on one side of the head 710. The illustrated head 710 extends outwardly beyond the periphery of the label system 720, which provides a relative large writing area. The label system 720 can be applied by the original manufacturer of the key blank, a lock smith, the end purchaser, and the like. Thus, the label system 720 can be applied to a key blank or a cut key.

The bond strength between the label system 720 and the head 710 is sufficiently high to minimize, limit, or substantially prevent relative movement between the label system 720 and the head 710, even when a user writes on the label system 720 with a writing instrument, such as a ballpoint pen. The label system 720 can thus remain securely adhered to the head 710 when a wide range of external forces are applied.

Figure 14C:
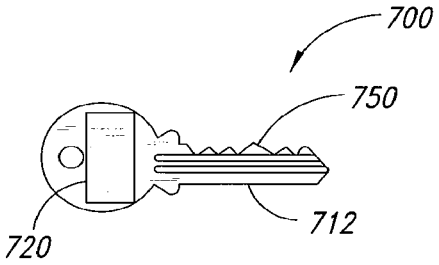
FIG. 14C is a plan view of the key of FIG. 14B after a machining process.

After applying the label system 720, the elongate main body 712, having a somewhat uniform profile along its longitudinal length, can be processed to form the desired contoured section. As shown in FIG. 14C, the elongate main body 712 has been machined to form the bitting 750. As used herein, the term "bitting" is broadly construed to include, without limitation, one or more indentations for operating one or more movable components of a mechanical lock.

Figure 14D:
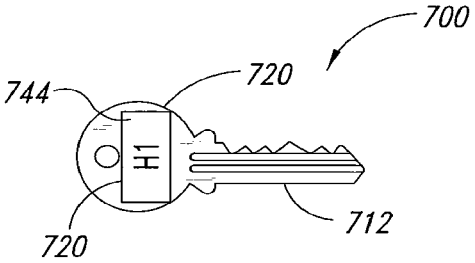
FIG. 14D is a plan view of the key of FIG. 14C after text has been applied to the label system.

Indicia can be placed on the label system 720 at any time before, during, and/or after the manufacturing process of FIGS. 14A-14D. As shown in FIG. 14D, text, illustrated as "H1," can be placed on an upper writable surface 744 of the label system 720. The indicia can correlate the key 700 to a particular lock(s).

Figure 15:
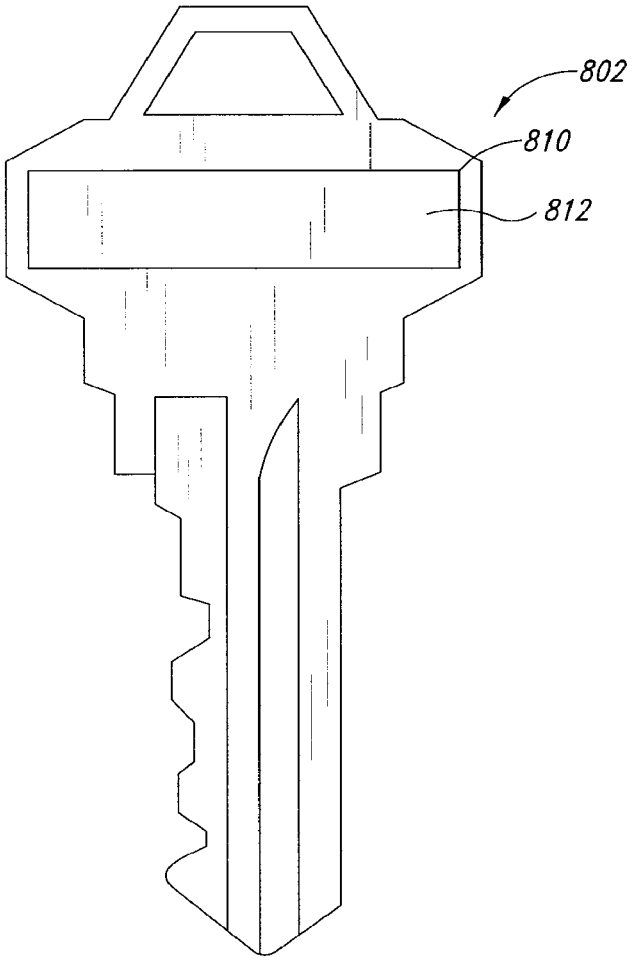
FIG. 15-16 show keys with label systems, in accordance with some embodiments.
Figure 16:
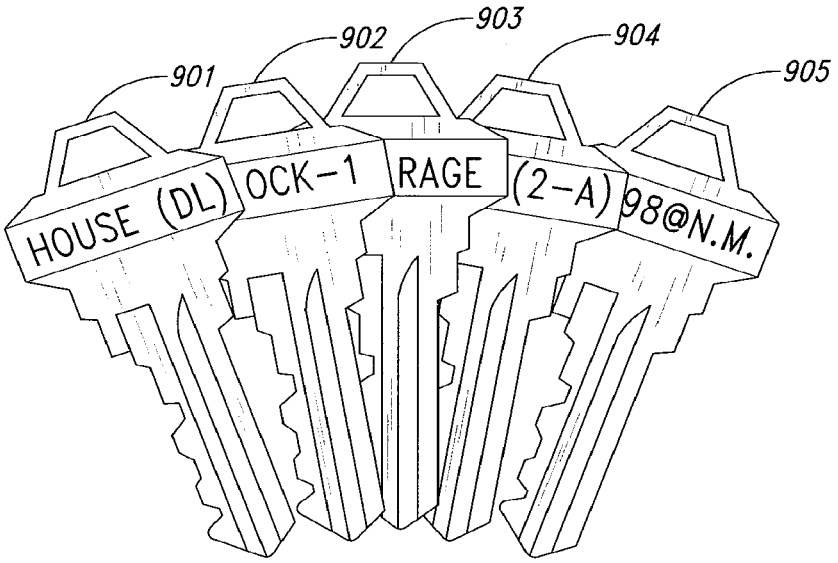

The label system 720 can also be formed at other times during or after the manufacturing of the key main body. In some embodiments, the label system 720 is applied to the key after the bitting 750 is formed. It is contemplated that the method shown in FIGS. 14A-14D can be performed with a wide range of key blanks, keys, and other modifiable devices. FIGS. 15-16 show various keys with label systems. FIG. 15 shows a key 802 with a discrete region 810 (e.g., a recessed region) for receiving a label system 812, illustrated as a flat layer. FIG. 16 shows a plurality of keys 901, 902, 903, 904, 905 having writing. The keys of FIG. 16 can be similar or identical to the key 802 of FIG. 15.

As noted above, the labels disclosed herein can be made, in whole or in part, of paper, fibers, plastics, polymers, rubbers, additives (e.g., nanoparticles, light activated additives, and other additives to alter the properties of the label), paint, adhesives, binders, fillers, or combinations thereof. The monolayer or multilayer label can be made of one or more materials that can provide a suitable writing surface. For example, the label can be made of fibers (wood pulp) and one or more additives (e.g., nanoparticles) that improve properties of the label, such as water resistance, writability, and the like. For example, coatings, materials, additives, and other teachings disclosed in U.S. Pat. Nos. 7,192,992; 7,153,892; 7,151,123; and U.S. Patent Publications 20070071965; 20060258765; 20060041047; 20050234152; 20050203205; 20050203202; 20050196605; 20050171227; 20050170280; 20050170101; 20050170100 can be used. The above-mentioned U.S. Pat. Nos. 7,192,992; 7,153,892; 7,151,123; and U.S. Patent Publications 20070071965; 20060258765; 20060041047; 20050234152; 20050203205; 20050203202; 20050196605; 20050171227; 20050170280; 20050170101; 2005017010 are hereby incorporated by reference herein and made a part of this specification.

Various methods and techniques described above provide a number of ways to carry out the invention. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

Furthermore, the skilled artisan will recognize the interchangeability of various features from different embodiments disclosed herein. Similarly, the various features and acts discussed above, as well as other known equivalents for each such feature or act, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. For example, the acts described in connection with FIGS. 14A to 14D can be performed in difference sequences. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof.

What is claimed is:

1. A method of manufacturing a key, the method comprising:

applying a liquid to a key blank comprising metal; and allowing the applied liquid to become solid so as to form a label system, the label system having a first surface and a second surface opposing the first surface, the first surface including an anti-smudge, anti-smear writable surface adapted to receive ink or a solid pigment from ballpoint pens for writing on paper, the second surface permanently and directly coupled to the key blank, a composition of the first surface is substantially the same as a composition of the second surface that is permanently and directly coupled to the key blank, and wherein the anti-smudge, anti-smear writable surface has a coefficient of friction sufficiently high such that ballpoint pens for writing on paper are capable of consistently applying ink to the writable surface.

2. The method of claim 1, wherein the label system is a monolayer adhered to an exposed outer surface of the key blank.

3. The method of claim 1, wherein the second surface is fused with an outer surface of the key blank.

4. The method of claim 1, wherein applying the liquid to the key blank includes applying a flowable uncured polymer to the key blank, and the method further comprising:

curing the polymer on the key blank to form the label system.

5. The method of claim 1, further comprising fusing the liquid to the key blank.

6. The method of claim 1, wherein the first surface and the second surface are formed of a material having the same composition.

7. The method of claim 1, wherein the label system comprises a porous material adapted to retain ink.

8. The method of claim 1, further comprising:

forming one or more bittings in an elongate main body of the key blank after applying the label system to the key blank, the elongate main body extends axially from a head of the key blank.

9. The method of claim 8, further comprising:

writing one or more indicium on the writable surface after forming the one or more bittings.

10. The method of claim 1, wherein a thickness of the label system is less than a thickness of a flat head of the key blank.

11. The method of claim 1, wherein the key blank comprises at least 90% by weight of metal.

12. A method of manufacturing a key, comprising:

applying a liquid to a key blank, wherein the key blank comprises at least 90% by weight of metal; and allowing the applied liquid to become solid so as to form a label permanently coupled to the key blank, wherein the label is sufficiently porous or includes a sufficient amount of nanoparticles to provide an exposed anti-smear surface of the label for receiving ink or a solid pigment from a writing implement, and wherein a composition of the label forming the exposed anti-smear surface is substantially the same as a composition of a surface of the label permanently coupled to the key blank;

wherein applying the liquid to the key blank includes applying the liquid directly to a head of the key blank to cover at least 90% of one side of the head of the key blank; and allowing the applied liquid to become solid such that the label is directly and permanently bonded to the head and has a coefficient of friction sufficiently high for being written upon by a ballpoint pen configured for writing on paper.

13. A method of manufacturing a key, comprising:

applying a liquid to a key blank, wherein the key blank comprises at least 90% by weight of metal; and allowing the applied liquid to become solid so as to form a label permanently coupled to the key blank, wherein the label is sufficiently porous or includes a sufficient amount of nanoparticles to provide an exposed anti-smear surface of the label for receiving ink or a solid pigment from a writing implement, and wherein a composition of the label forming the exposed anti-smear surface is substantially the same as a composition of a surface of the label permanently coupled to the key blank;

wherein the label is configured to be written upon by a ballpoint pen such that the ballpoint pen consistently applies ink to the anti-smear surface.

14. A method of manufacturing a key, comprising:

applying a liquid to a key blank, wherein the key blank includes at least 90% by weight metal and includes a main body and a head connected to the main body, wherein the head is grippable between fingers of a user for operating a mechanical lock when the main body engages the mechanical lock; and allowing the applied liquid to become a solid layer so as to form a writable label permanently coupled to the key blank, wherein the label is sufficiently porous or includes a sufficient amount of nanoparticles to provide an exposed anti-smear, anti-smudge surface with a coefficient of friction sufficiently high for being written upon by a ballpoint pen, which is configured for writing on paper, such that the ballpoint pen consistently applies ink to the label, and wherein a composition of the exposed anti-smear, anti-smudge surface is substantially the same as a composition of a surface of the label permanently coupled to the key blank.

* * * * *